United States Patent [19]

Mirjanic

[11] Patent Number: 4,656,982

[45] Date of Patent: Apr. 14, 1987

[54] ENGINE CYLINDER LINER ARRANGEMENT

[75] Inventor: Milorad Mirjanic, Fellbach, Fed. Rep. of Germany

[73] Assignee: Daimler-Benz Aktiengesellschaft, Fed. Rep. of Germany

[21] Appl. No.: 735,578

[22] Filed: May 20, 1985

[30] Foreign Application Priority Data

May 22, 1984 [DE] Fed. Rep. of Germany ..... 3419003

[51] Int. Cl.[4] ..... F01B 21/00

[52] U.S. Cl. ..... 123/193 CH; 123/41.84

[58] Field of Search ..... 123/193 R, 193 C, 193 CH, 123/41.84

[56] References Cited

U.S. PATENT DOCUMENTS

| | | | |
|---|---|---|---|
| 1,342,633 | 6/1920 | Lagersten | 123/193 CH |
| 2,939,753 | 6/1960 | Schilling et al. | 123/193 CH |
| 3,340,774 | 9/1967 | Brenneke | 123/193 CH |
| 3,389,693 | 6/1968 | Herschmann et al. | 123/41.84 |
| 3,853,099 | 12/1974 | Feather et al. | 123/41.84 |
| 4,305,348 | 12/1981 | Martin | 123/41.84 |
| 4,562,798 | 1/1986 | Van Os | 123/193 CH |

FOREIGN PATENT DOCUMENTS

| | | | |
|---|---|---|---|
| 1186685 | 4/1965 | Fed. Rep. of Germany | 123/193 CH |
| 1751176 | 8/1970 | Fed. Rep. of Germany | . |
| 484055 | 4/1938 | United Kingdom | 123/193 CH |
| 609011 | 9/1948 | United Kingdom | 123/193 CH |

*Primary Examiner*—Craig R. Feinberg

*Attorney, Agent, or Firm*—Barnes & Thornburg

[57] ABSTRACT

A cylinder lining is inserted into a cylinder block of an internal-combustion engine with an upper collar of the disposed in a recess in the cylinder block. To hold the lining in place, a ring is prestressingly inserted from above into an opening in the collar between the liner and the cylinder block recess wall. In order to prevent radial movements between the collar of the lining and the cylinder block, the ring that is formed as a clamping ring and the interior surface of which is developed as a conical surface with the same slope is pressed in between the conically formed outer wall of the collar of the lining and the recess.

7 Claims, 1 Drawing Figure

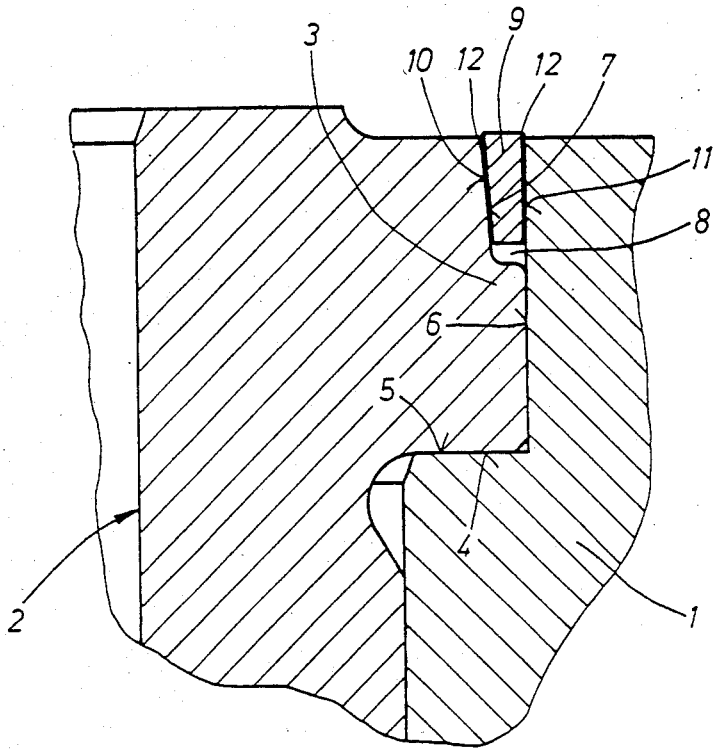
3
10
12
9
12
7
11
8
6
5
4
2
1

ENGINE CYLINDER LINER ARRANGEMENT

BACKGROUND AND SUMMARY OF THE INVENTION

This invention relates to a cylinder liner arrangement for an internal-combustion engine. More particularly the present invention is related to an improved liner arrangement of the type including prestressing a ring to hold a cylinder lining in a cylinder block.

In the case of a cylinder lining of this type that is described in German Published Unexamined Patent Application (DE-OS) No. 1 175 176, a thin-walled ring, with slight prestressing, is shrunk onto a collar of the lining on the outside. It has the purpose of preventing that cooling water flows out of a ring groove in the collar of the lining.

The invention is based on the objective of preventing, or at least reducing to a minimum, radial movements between the cylinder lining and the cylinder block which are caused by the normal force of the piston and the gas pressure in the upper part of the cylinder, and which radial movements result in wear or abrasion in the bearing of the collar of the lining on the cylinder block.

According to the invention, this objective is achieved by providing an arrangement wherein a conical surface is provided on the exterior edge of the lining collar which is sloped inwardly in the upward direction, and wherein the ring formed as a clamping ring is provided on its inner surface with similar slope as the ring collar edge, the ring being pressed in place between a recess in the cylinder block and the collar conical surface.

The clamping ring pressed in between the collar of the lining and the cylinder block causes a radial support between these two parts so that forces affecting the collar of the lining radially are completely absorbed by the cylinder block. Simultaneously, the collar of the lining, by means of the pressed-in clamping ring, is axially pressed firmly onto its bearing surface in the cylinder block. Both measures prevent a radial movement between the collar of the lining and the cylinder block which may result in wear in the bearing surface of the collar of the lining on the cylinder block. In addition, the clamping ring, as a metallic bridge, also improves the heat discharge from the collar of the lining to the cylinder block.

In especially preferred embodiments resulting in a self-locking fastening of the clamping ring the collar conical surface and the interior surface of the clamping ring are sloped at about 6° with respect to lines parallel to the reciprocating axis of the piston in the cylinder block and lining arrangement.

Further objects, features, and advantages of the present invention will become more apparent from the following description when taken with the accompanying drawing which shows, for purposes of illustration only, an embodiment in accordance with the present invention.

BRIEF DESCRIPTION OF THE DRAWINGS

The single drawing FIGURE is a partial schematic sectional view showing portions of an internal combustion engine cylinder block with a cylinder liner arrangement constructed in accordance with a preferred embodiment of the invention.

DETAILED DESCRIPTION OF THE DRAWINGS

In a cylinder block 1 of a reciprocating piston internal-combustion engine that is not shown in detail, a cylinder lining 2 is inserted. At the upper end of the cylinder lining 2 a collar 3 is provided. Collar 3 is provided with a bearing surface 4 which rests on a base 5 of a recess 6 in the cylinder block 1. The collar 3 of the lining, in its upper half on the outside, is provided with a conical surface 7 which is sloped at an angle of a little less than 6° upwardly and inwardly in the direction of the cylinder shaft. A clamping ring 9 is pressed from the top into the space 8 between the conical surface 7 and the cylinder block 1, the interior surface 10 of the clamping ring has the same slope as the conical surface 7 of the collar 3 of the lining. Thus the collar 3 of the lining with its bearing surface 4 is pressed firmly onto the cylinder block 1, and a radial support of the collar 3 of the lining at the cylinder block 1 is achieved via the clamping ring 9 so that movements in the radial direction between the collar 3 of the lining and the cylinder block 1 and thus a wearing of the bearing surface 4 and of the base surface 5 are prevented.

The interior surface 10 and the exterior surface 11 of the clamping ring 9 have galvanic coatings 12 made of a soft metal, such as tin, in particularly preferred embodiments. This facilitates the pressing-in of the clamping ring 9 and further improves the contact of the clamping ring 9 with the collar 3 of the lining and the cylinder block even more.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A cylinder liner arrangement for lining cylinder block means of an internal combustion engine, comprising:

a liner exhibiting a collar engageable with a bearing support surface of the block means to axially support the liner in position, the block means having a topmost edge and the liner having an outward edge terminating at a height approximating the topmost edge, and a single clamping ring disposable between a ring support surface of the liner and a ring support surface of the cylinder block means to clampingly hold the liner in position at the bearing surface of the cylinder block means and to provide radial support for the liner against the block means, wherein the clamping ring and one of the liner and cylinder block means exhibit mating sloped conical surfaces with the clamping ring being narrower at its bottom than at its top when inserted downwardly from above in a vertically disposed cylinder arrangement, and wherein said mating sloped conical surfaces are configured to self-lockingly fasten the clamping ring with the mating surface of one of the liner and cylinder block means so that the clamping ring is maintained between the two ring support surfaces so as to hold the liner axially against the bearing surface and to provide a radial support between the ring support surface of the liner against the ring support surface of the cylinder block.

2. An arrangement according to claim 1, wherein the interior surface of the clamping ring, closest to the cylinder axis, is sloped upwardly inwardly toward the cylinder axis.

3. An arrangement according to claim 2, wherein the mating surface is on the liner, and wherein the mating surfaces of the clamping ring and the liner are provided with the same slope.

4. An arrangement according to claim 1, wherein the mating conical surface at the clamping ring extends at an angle of about 6° with respect to the vertical with a vertically oriented cylinder liner.

5. An arrangement according to claim 3, wherein the mating conical surface at the clamping ring extends at an angle of about 6° with respect to the vertical with a vertically oriented cylinder liner.

6. An arrangement according to claim 4, wherein said angle is slightly less than 6°.

7. An arrangement according to claim 5, wherein said angle is slightly less than 6°.

* * * * *